US005988880A

United States Patent [19]

Tomic

[11] Patent Number: 5,988,880

[45] Date of Patent: Nov. 23, 1999

[54] RESEALABLE CLOSURE MECHANISM

[75] Inventor: Mladomir Tomic, Appleton, Wis.

[73] Assignee: Reynolds Consumer Products, Inc., Appleton, Wis.

[21] Appl. No.: 09/083,554

[22] Filed: May 22, 1998

[51] Int. Cl.[6] ..... B65D 33/16

[52] U.S. Cl. ..... 383/63; 24/400; 24/587; 383/59

[58] Field of Search ..... 383/63, 64, 65, 383/59; 24/399, 400, 587

[56] References Cited

U.S. PATENT DOCUMENTS

| | | | |
|---|---|---|---|
| 2,144,755 | 1/1939 | Freedman | 383/65 |
| 3,986,914 | 10/1976 | Howard | 156/251 |
| 4,561,108 | 12/1985 | Kamp | 383/63 |
| 4,658,433 | 4/1987 | Savicki | 383/63 |
| 4,736,496 | 4/1988 | Fisher et al. | 383/63 |
| 4,756,629 | 7/1988 | Tilman et al. | 383/63 |
| 4,832,505 | 5/1989 | Ausnit et al. | 383/63 |
| 4,854,017 | 8/1989 | Kamp | 383/63 |
| 4,890,935 | 1/1990 | Ausnit et al. | 383/59 |
| 4,907,321 | 3/1990 | Williams | 383/63 |
| 4,949,527 | 8/1990 | Boeckmann et al. | 383/63 |
| 5,012,561 | 5/1991 | Porchia et al. | 383/63 |
| 5,118,202 | 6/1992 | Bruno | 383/63 |
| 5,209,574 | 5/1993 | Tilman | 383/63 |
| 5,351,369 | 10/1994 | Swain | 24/304 |
| 5,369,847 | 12/1994 | Naya et al. | 383/65 |
| 5,372,428 | 12/1994 | Bruno et al. | 383/63 |
| 5,558,439 | 9/1996 | Tilman | 383/63 |
| 5,577,305 | 11/1996 | Johnson | 383/63 |
| 5,810,478 | 9/1998 | LaFleur | 383/63 |

*Primary Examiner*—Stephen P. Garbe
*Attorney, Agent, or Firm*—Alan M. Biddison

[57] ABSTRACT

The resealable package includes a first panel section sealed to a second panel section along two side edges and a bottom edge. The sealed edges define an enclosed region having a mouth that provides access to the enclosed region. The package also includes a closure arrangement for opening and sealing the mouth. The closure arrangement is oriented in the mouth and secured to the first and second panel sections. The closure arrangement and a seal along one of the side edges define a gap having a first area. The closure arrangement includes two closure profiles. Each closure profile has a base strip and an interlocking closure member extending from the base strip. The two closure profiles are designed to selectively interlock. The interlocking closure member of the first closure profile is designed to reduce the area of the gap between the closure arrangement and the side seal.

14 Claims, 5 Drawing Sheets

RESEALABLE CLOSURE MECHANISM

FIELD OF THE INVENTION

The present invention generally relates to closure arrangements for polymeric packages and, in particular, to resealable closure mechanisms for polymeric packages.

BACKGROUND

Many packaging applications use resealable containers to store various types of articles and materials. These packages may be used to store and ship food products, non-food consumer goods, medical supplies, waste materials, and many other articles.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

The resealable closure mechanism is often produced as a separate item from the package and is attached to and made integral with the package at a later point in the manufacturing process. Each separate closure profile includes a base strip and interlocking member.

One closure profile may have a rib or male member and the other, a mating groove or female member. The male or female member extends from the front face of the base strip. The rib and groove form a pressure fastenable and releasable closure mechanism. The back side, or sometimes an extended portion of the front face of the base strip is sealed to the package film so this closure mechanism is disposed between the package walls adjacent to the openable side of the package.

One disadvantage of this closure arrangement is that the side seals often are not leak-proof. When the sides of the package are sealed, the sealing process leaves a gap above or below the closure mechanism due to the larger thickness of the closure profiles relative to the package films. This gap allows materials, and in particular fluids, to leak out the side of the package.

SUMMARY OF THE INVENTION

In one aspect of the present invention, one example embodiment involves a resealable package. The resealable package includes a first panel section sealed to a second panel section along two side edges and a bottom edge. The sealed edges define an enclosed region having a mouth that provides access to the enclosed region. The package also includes a closure arrangement for opening and sealing the mouth. The closure arrangement is oriented in the mouth and secured to the first and second panel sections. The closure arrangement and a seal along one of the side edges define a gap having a first area. The closure arrangement includes two closure profiles. Each closure profile has a base strip and an interlocking closure member extending from the base strip. The two closure profiles are designed to selectively interlock. The interlocking closure member of the first closure profile is designed to reduce the area of the gap.

According to another aspect of the present invention, another example embodiment involves a method of manufacturing a resealable package having first and second opposing panel sections and an interior. The method includes placing the first panel section adjacent to the second panel section; placing a closure arrangement between the first panel section and the second panel section, the closure arrangement providing access to the interior of the package and having structure as described herein; securing the closure arrangement to the first and second panel sections; and sealing a plurality of edges of the first panel section to a plurality of edges of the second panel section.

The above summary of the present invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
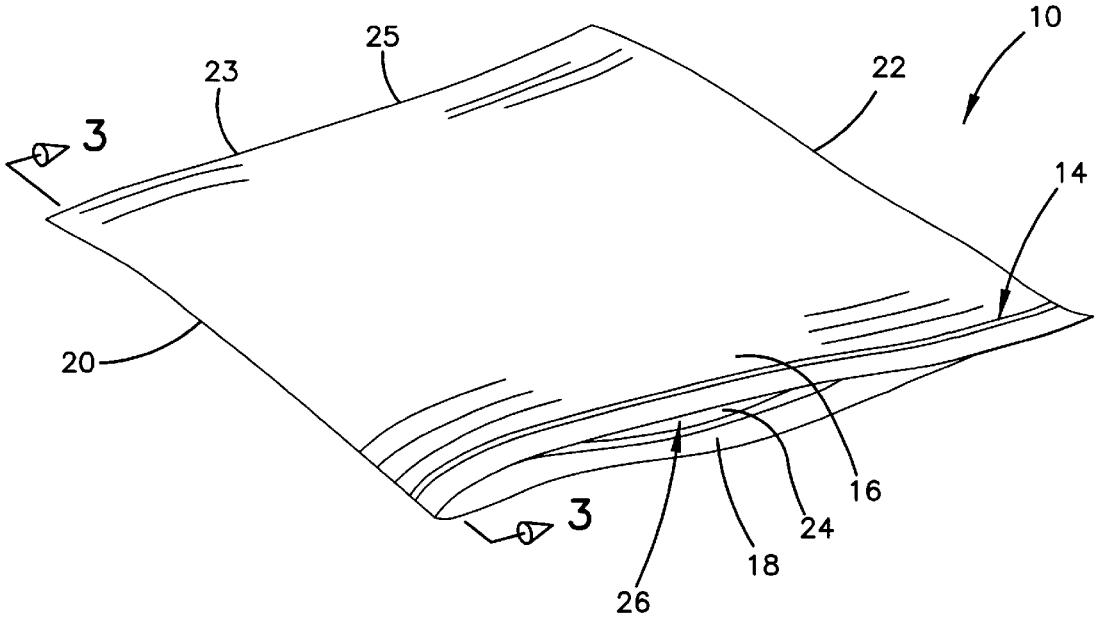
FIG. 1 is a perspective view of a flexible, resealable package, according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a variety of packaging arrangements. The invention has been found to be particularly advantageous for manufacturing resealable closure mechanisms. An appreciation of various aspects of the invention is best gained through a discussion of an application example for such a packaging arrangement.

According to an example embodiment of the present invention, the area of a transition triangle below or above the resealable closure mechanism at the side seal of the package is reduced, improving the side hermetic seal of the package. FIG. 1 illustrates an example type of package 10 that benefits from the use of such resealable closure mechanisms.

FIG. 1 illustrates an example packaging arrangement in the form of a flexible package 10 having a closure mechanism 14 constructed in accordance with the present invention. The flexible package 10 includes first and second opposed panel sections 16, 18, typically made from a flexible, polymeric film. For some manufacturing applications, the first and second panel sections 16, 18 are heat-sealed together along two edges 20, 22 and meet at a fold line 23 in order to form a three-edged containment section for a product within the interior of the package 10. The fold line 23 comprises a product supporting bottom or bottom edge 25, depending on the orientation that the package 10 is held. Alternatively, two separate panel sections 16, 18 of polymeric film may be used and heat-sealed together along the two opposite edges 20, 22 and along the bottom edge 25. Access is provided to the interior 24 of the package 10 through a mouth 26. In other implementations, the package 10 includes tear strings and/or notches at the mouth 26 to assist with opening the package 10.

The package 10 includes a product side and a consumer side. As used herein, the term "product side" refers to the volume inside of the package 10 between the closure mechanism 14, the two side edges 20, 22, and the bottom edge 25. The "consumer side" refers to a side opposite of the product side, and is in the region of the package 10 accessible by the user.

The flexible package 10 may be used to hold a variety of products. Such products may include groceries, edible food products, clothing, liquids, and other articles.

A resealable closure mechanism 14 is illustrated in FIG. 1 at the mouth 26 of the flexible package 10. Each closure mechanism 14 extends the entire width of the package 10. The closure mechanism 14 can be one of a variety of closure mechanisms. In the particular embodiments illustrated in FIGS. 2–8, the resealable closure mechanism 14 of FIG. 1 is shown in the specific form of a dual-track zipper-type mechanism 14. By "dual-track," it is meant that the closure mechanism has two sets of interlocking closure flanges. In the particular embodiment illustrated in FIG. 9, the resealable closure mechanism 14 of FIG. 1 is shown in the specific form of a single-track zipper-type mechanism. By "single-track," it is meant that the closure mechanism has a single set of interlocking closure flanges. By the term "zipper-type mechanism," it is meant a structure having oppositely disposed interlocking or mating profiles, which under the application of pressure, will interlock and block access between the profiles.

Figure 2:
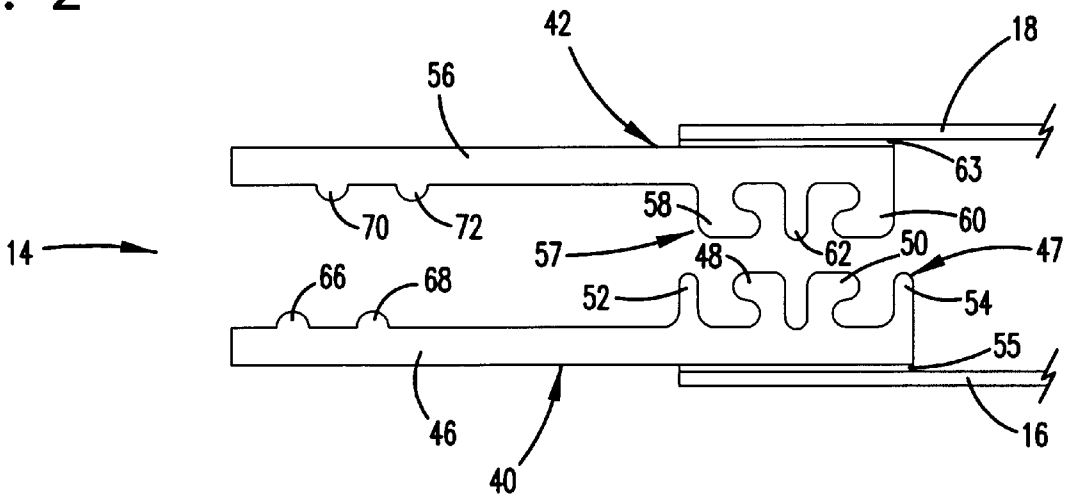
FIG. 2 is a fragmented, cross-sectional, somewhat schematic view of a resealable closure mechanism, according to an example embodiment of the present invention.

Attention is directed to FIG. 2. The closure mechanism 14 is shown in expanded form and includes an elongated male closure profile 40 and an elongated female closure profile 42. Typically, the closure profiles 40, 42 are manufactured separately from each other. The male closure profile 40 is comprised of a base strip 46, an interlocking closure member 47, two gripping ridges 66, 68, and a sealant layer 55. The interlocking closure member 47 has two interlocking closure flanges 48, 50 and two guide posts 52, 54. The sealant layer 55 is attached to the first panel section 16 of the package 10 of FIG. 1. The sealant layer 55 facilitates bonding between the closure profile 40 and the first panel section 16. The base strip 46 is attached to the sealant layer 55. The interlocking closure flanges 48, 50 extend out from the base strip 46 and are generally perpendicular to the base strip 46. The guide posts 52, 54 also extend out from the base strip 46 and are generally perpendicular to the base strip 46. The guide posts 52, 54 aid in holding the closure mechanism 14 closed and in aligning the male closure profile 40 with the female closure profile 42. The gripping ridges 66, 68 extend out from the base strip 46 and aid the consumer in grasping the closure profile 40. Alternatively, the male closure profile 40 does not have a sealant layer 55. In this implementation, the base strip 46 is attached directly to the first panel section 16 of the package 10 of FIG. 1.

The female closure profile 42 is likewise comprised of a base strip 56, an interlocking closure member 57, two gripping ridges 70, 72, and a sealant layer 63. The interlocking closure member 57 has two interlocking closure flanges 58, 60 and a guide post 62. The sealant layer 63 is attached to the second panel section 18 of the package 10 of FIG. 1. The sealant layer 63 facilitates bonding between the closure profile 42 and the second panel section 18. The base strip 56 is attached to the sealant layer 63. The interlocking closure flanges 58, 60 extend out from the base strip 56 and are generally perpendicular to the base strip 56. The guide post 62 also extends out from the base strip 56 and is generally perpendicular to the base strip 56. The guide post 62 aids in holding the closure mechanism 14 closed and in aligning the female closure profile 42 with the male closure profile 40. The gripping ridges 70, 72 extend out from the base strip 56 and aid the consumer in grasping the closure profile 42. Alternatively, the female closure profile 42 does not have a sealant layer 63. In this implementation, the base strip 56 is attached directly to the second panel section 18 of the package 10 of FIG. 1 or directly heat sealed to a bag wall film that has the sealant layer.

The male and female closure profiles 40, 42 are designed to engage with one another to form a resealable closure mechanism 14. The interlocking closure flanges 48, 50 of the male closure profile 40 and the interlocking closure flanges 58, 60 of the female closure profile 42 extend from the base strips 46, 56, respectively, a sufficient distance to allow mechanical engagement therebetween. Pressure is applied to the closure profiles 40, 42 as they engage and form a resealable closure mechanism 14. To open the closure mechanism 14, the consumer grasps the male closure profile 40 from the consumer side of the package 10 and pulls it away from the female closure profile 42, causing the two closure profiles 40, 42 to disengage. The gripping ridges 66, 68 of the male closure profile 40 and the gripping ridges 70, 72 of the female closure profile 42 provide the consumer with a place to grasp the closure profiles 40, 42 to pull them apart. The closure profiles 40, 42 are also sealed together at side edges 20, 22 of FIG. 1 to further aid in aligning the closure profiles 40, 42.

In some applications, the closure profiles 40, 42 are formed by two separate extrusions or through two separate openings of the common extrusion. Typically, the resealable closure mechanism 14 is made of a flexible polymeric material, such as polyethylene or polypropylene. In one example embodiment, the closure arrangement illustrated in FIG. 2 is manufactured using conventional extrusion and heat sealing techniques. In particular, the closure profiles 40, 42 are extruded through a die plate fed by a plurality of extruders. These extruders carry the different molten materials for forming the closure profiles 40, 42. As is well known in the art, the die plate includes input ports, output ports, and channels connecting these input ports to output ports. The extruders feed the different molten materials to different input ports, and the channels are designed to configure the molten materials into the shape of the closure profiles 40, 42. Typically, the sealant layers 55, 63 are coextruded with the closure profiles 40, 42, such that the sealant layers 55, 63 are bonded to the base strips 46, 56, respectively, of the male and female closure profiles 40, 42, respectively.

Figure 3:
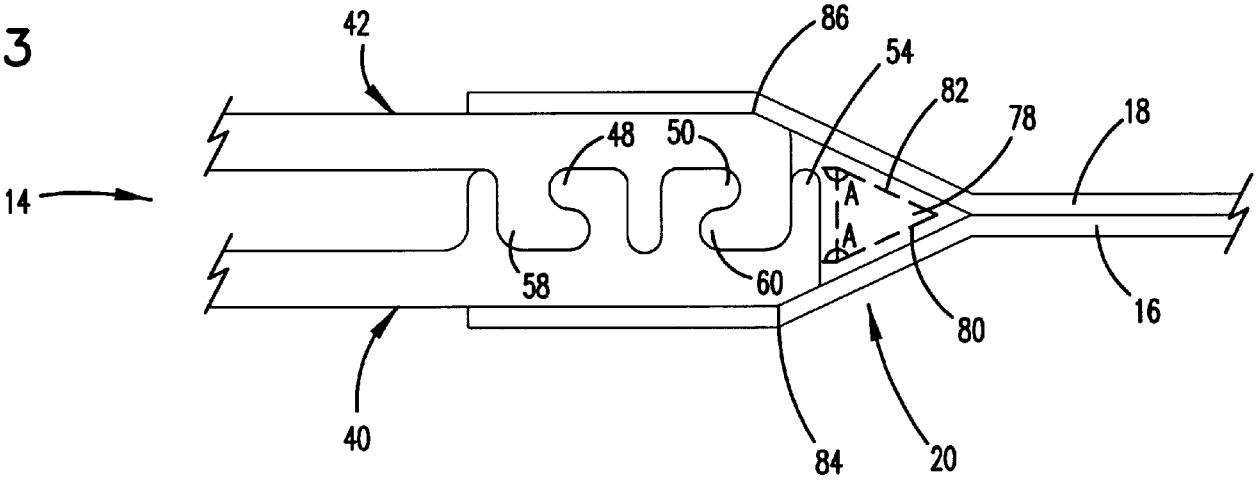
FIG. 3 is a fragmented, cross-sectional, somewhat schematic view of the resealable closure mechanism of FIG. 2 at the side seal of the package of FIG. 1, also according to an example embodiment of the present invention.

Attention is directed to FIG. 3. FIG. 3 is a cross-sectional view of the package 10 of FIG. 1 taken along one of the side seal edges 20. The closure profiles 40, 42 of FIG. 2 are shown in their interlocked position. In this embodiment, the closure profiles 40, 42 do not have sealant layers and are bonded directly to package films 16, 18, respectively. The interlocking closure flanges 58, 60 of the female closure profile 42 have mechanically engaged with the interlocking closure flanges 48, 50 of the male closure profile 40. The package 10 is hermetically sealed along the side edge 20. The sealing process incompletely seals the side edge 20. Due to the thickness of the closure mechanism 14 relative to the thin panel sections 16, 18 of the package 10, the sealing process leaves a gap, or transition triangle, either on the product side or the consumer side of the closure mechanism 14. As illustrated in FIG. 3, the gap is on the product side of the closure mechanism 14 and is represented as region 78. The region 78 generally has a triangular cross-section and has two legs 80, 82. The legs 80, 82 define an angle A with respect to the base strips 46, 56, respectively. The large area of the region 78 allows materials to pass through the side edge 20. To reduce these leaks, the closure profiles 40, 42 are designed to reduce the area of the region 78, and thereby further seal the side edge 20 of package 10 of FIG. 1. Particularly, the guide post 54 of the male closure profile 40 and the interlocking closure flange 60 of the female closure profile 42 are bent at points 84, 86, respectively. The angle of the bends 84, 86 is approximately equal to angle A of the triangular region 78. The bending of the guide post 54 and the interlocking closure flange 60 allows the side edges 20, 22 to be sealed closer to the closure mechanism 14, thus reducing the area of the region 78.

Figure 4:
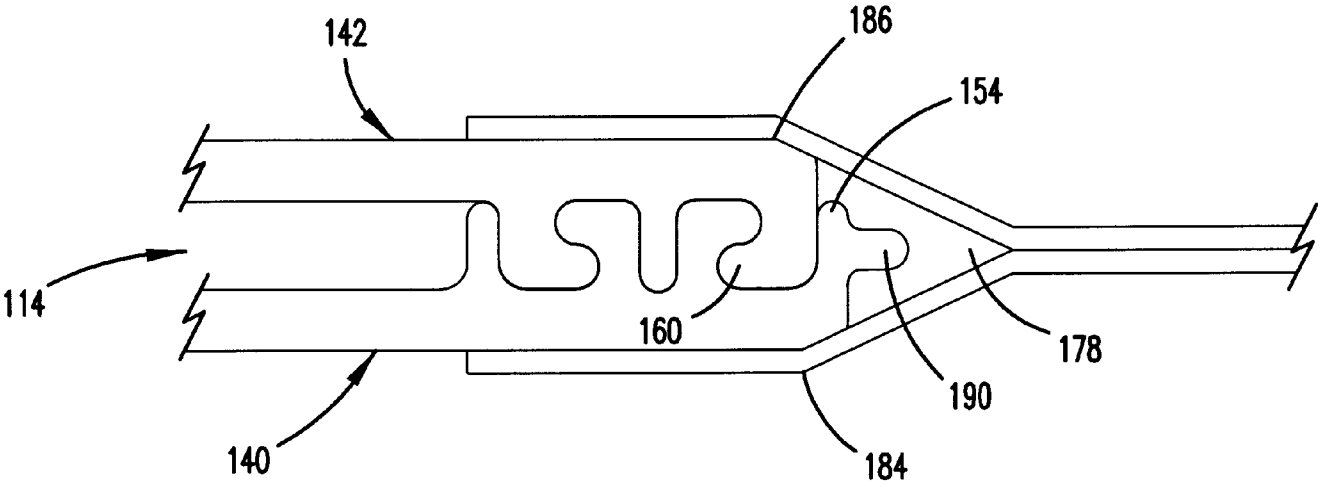
FIG. 4 is a fragmented, cross-sectional, somewhat schematic view of a resealable closure mechanism, according to a second example embodiment of the present invention.

Attention is directed to FIG. 4. The closure profiles 140, 142 have structure analogous to the closure profiles 40, 42, respectively, of FIG. 2. The guide post 154 of the male closure profile 140 is bent at 184. Likewise, the interlocking closure flange 160 of the female closure profile 142 is bent at 186. As described herein, the bending of the guide post 154 and the interlocking closure flange 160 allows the side edges 20, 22 of the package 10 of FIG. 1 to be sealed closer to the closure mechanism 114. In addition, a protrusion or horizontal rib 190 is coextruded with the male closure profile 140. In this particular embodiment, the horizontal rib 190 extends outwardly from the guide post 154 and is generally perpendicular to the guide post 154. The horizontal rib 190 further reduces the area of the triangular region 178. The horizontal rib 190 is shaped as a rib or knob. The horizontal rib 190 could be one of a variety of shapes designed to take up space and reduce the area of the region 178.

Figure 5:
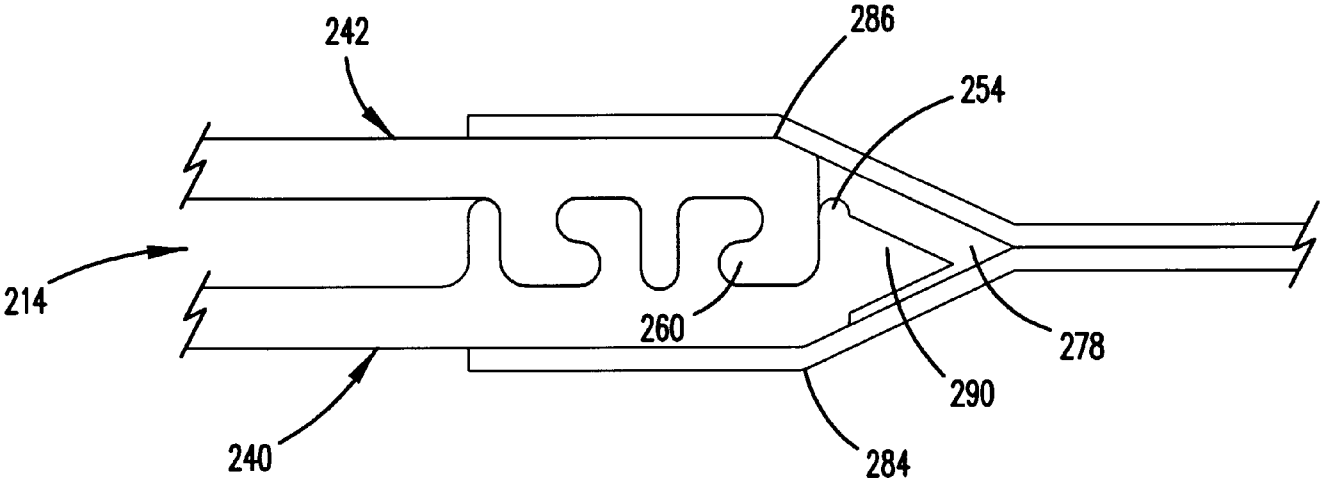
FIG. 5 is a fragmented, cross-sectional, somewhat schematic view of a resealable closure mechanism, according to a third example embodiment of the present invention.

Attention is directed to FIG. 5. The closure profiles 240, 242 have structure analogous to the closure profiles 140, 142, respectively, of FIG. 4. The guide post 254 of the male closure profile 240 is bent at 284. Likewise, the interlocking closure flange 260 of the female closure profile 242 is bent at 286. As described herein, the bending of the guide post 254 and the interlocking closure flange 260 allows the side edges 20, 22 of the package 10 of FIG. 1 to be sealed closer to the closure mechanism 214. In addition, a protrusion or horizontal rib 290 is coextruded with the male closure profile 240. In this particular embodiment, the horizontal rib 290 extends outwardly from the guide post 254. The horizontal rib 290 further reduces the area of the triangular region 278. In this embodiment, the horizontal rib 290 is triangularly shaped congruous to the triangular region 278. The triangular shape of the horizontal rib 290 allows the size of the horizontal rib 290 to be greater, while still fitting within the triangular region 278, thus further reducing the area of the region 278.

Figure 6:
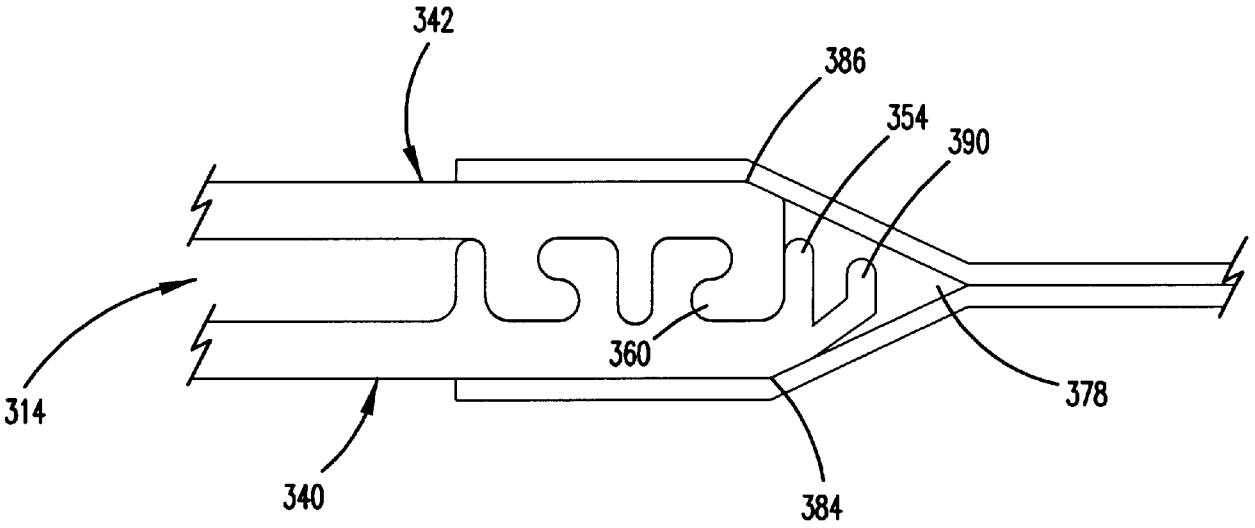
FIG. 6 is a fragmented, cross-sectional, somewhat schematic view of a resealable closure mechanism, according to a fourth example embodiment of the present invention.

Attention is directed to FIG. 6. The closure profiles 340, 342 have structure analogous to the closure profiles 40, 42 of FIG. 3. The guide post 354 of the male closure profile 340 is bent at 384. Likewise, the interlocking closure flange 360 of the female closure profile 342 is bent at 386. In addition, a protrusion or finger 390 is coextruded with the male closure profile 340. The finger 390 extends outwardly from the guide post 354 at the same angle as the angle at 384. This angle is approximately the same as angle A of the triangular region 78 of FIG. 3. The finger 390 further reduces the area of the region 378.

Figure 7:
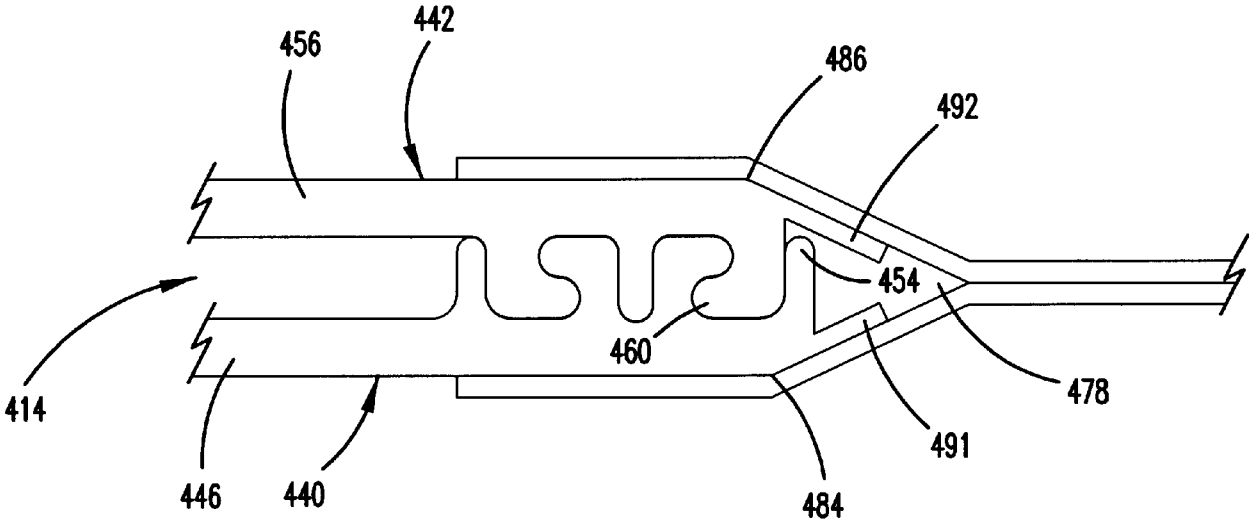
FIG. 7 is a fragmented, cross-sectional, somewhat schematic view of a resealable closure mechanism, according to a fifth example embodiment of the present invention.

Attention is directed to FIG. 7. The closure profiles 440, 442 have structure analogous to the closure profiles 40, 42, respectively, of FIG. 3. The base strip 446 of the male closure profile 440 has an extension 491 that is bent at 484. Likewise, the base strip 456 of the female closure profile 442 has an extension 492 that is bent at 486. The angle of these bends 484, 486 is approximately the same as angle A of the triangular region 78 of FIG. 3. The base extensions 491, 492 are coextruded with the closure profiles 440, 442, respectively. The base extensions 491, 492 extend into the transition triangle 478, reducing the area of the region 478.

Figure 8:
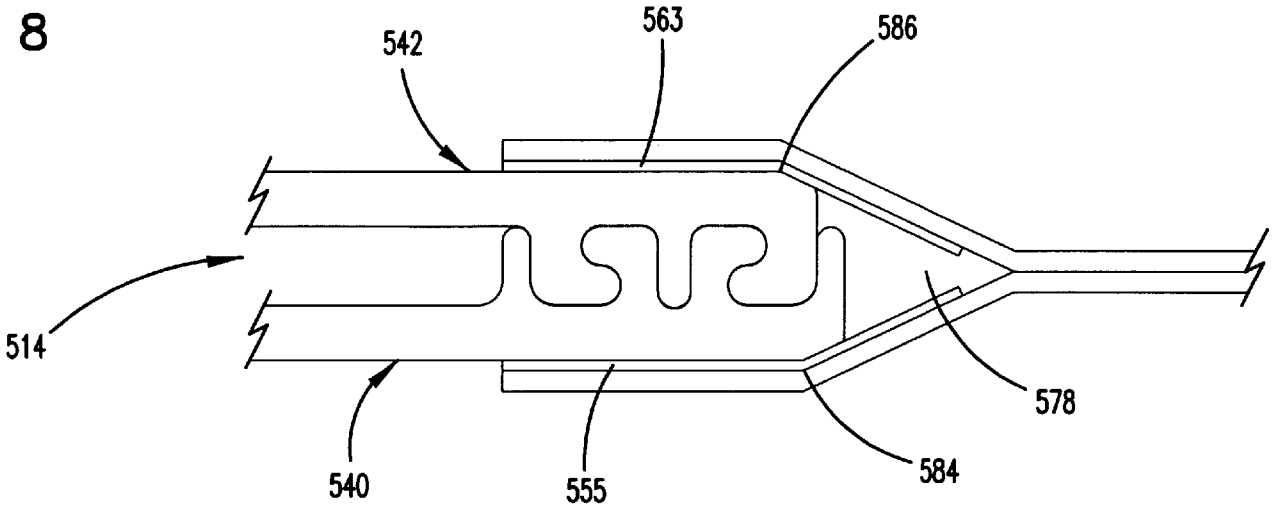
FIG. 8 is a fragmented, cross-sectional, somewhat schematic view of a resealable closure mechanism, according to a sixth example embodiment of the present invention.

Attention is directed to FIG. 8. The closure profiles 540, 542 have structure analogous to the closure profiles 40, 42, respectively, of FIG. 3. In this particular embodiment, the sealant layer 555 of the male closure profile 540 is extended into the triangular region 578 and is bent at 584. Likewise, the sealant layer 563 of the female closure profile 542 is extended into the region 578 and is bent at 586. The angle of these bends 584, 586 is approximately the same as angle A of the triangular region 78 of FIG. 3. The sealant layers 555, 563 are coextruded with the closure profiles 540, 542. The extension of the sealant layers 555, 563 into the region 578 reduces the area of the region 578.

Figure 9:
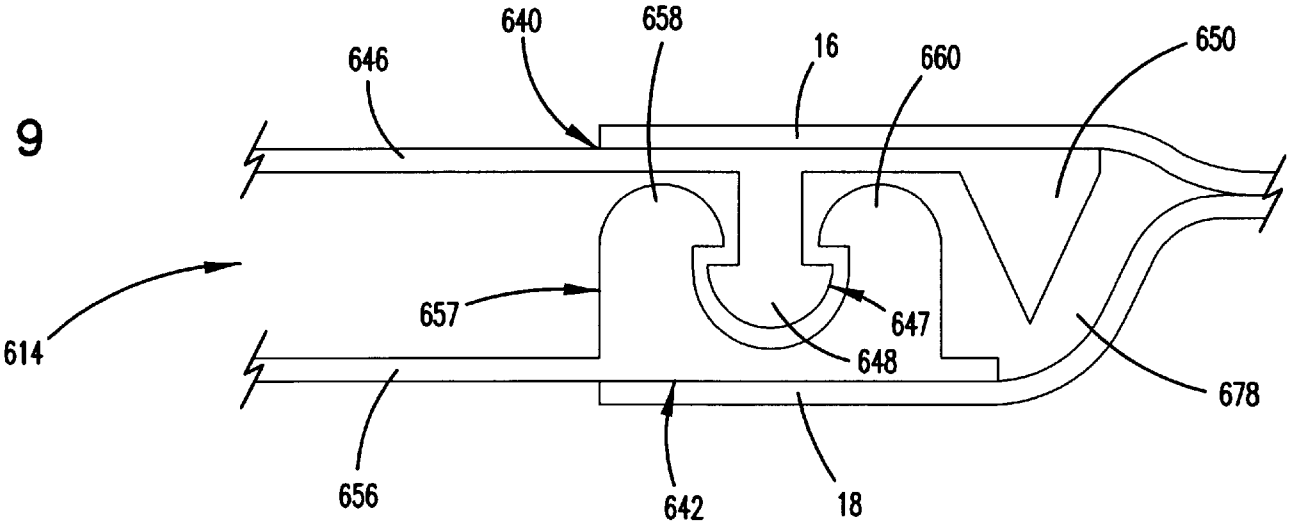
FIG. 9 is a fragmented, cross-sectional, somewhat schematic view of a resealable closure mechanism, according to a seventh example embodiment of the present invention.

Attention is directed to FIG. 9. In this particular embodiment, the male closure profile 640 is comprised of a base strip 646 and an interlocking closure member 647. The interlocking closure member 647 has an interlocking closure flange 648. The base strip 646 is attached to the first package film 16 of package 10 of FIG. 1. The male closure profile 640 also includes a ridge 650. The ridge 650 extends out from the base strip 646. The shape and size of ridge 650 are designed to reduce the area of the triangular region 678. The ridge 650 is coextruded with the male closure profile 640. The female closure profile 642 is comprised of a base strip 656 and an interlocking closure member 657. The interlocking closure member 657 has two interlocking closure flanges 658, 660. The base strip 656 is attached to the second package film 18 of package 10 of FIG. 1.

The male and female closure profiles 640, 642 are designed to engage with one another to form a resealable closure mechanism 614. The interlocking closure flange 648 of the male closure profile 640 and the interlocking closure flanges 658, 660 of the female closure profile 642 extend from the base strips 646, 656, respectively, a sufficient distance to allow mechanical engagement therebetween. Pressure is applied to the closure profiles 640, 642 as they engage and form a resealable closure mechanism 614. To open the closure mechanism 614, the consumer grasps the male closure profile 640 from the consumer side of the package 10 and pulls it away from the female closure profile 642, causing the two closure profiles 640, 642 to disengage. Closure profiles 640, 642 are also sealed together at edges 20, 22 of FIG. 1 to further aid an aligning of the closure profiles 640, 642.

The above specification and examples are believed to provide a complete description of the manufacture and use of particular embodiments of the invention. Many embodiments of the invention can be made without departing from the spirit and scope of the invention.

I claim:

1. In a resealable package comprising:

(a) a first panel section sealed to a second panel section along first and second side edges, the sealed side edges defining an enclosed region having a mouth providing access to the enclosed region, and (b) a closure arrangement for selectively opening and sealing the mouth, the closure arrangement being oriented in the mouth and secured to the first and second panel sections, the closure arrangement including:

(i) a first closure profile having a first base strip and a first interlocking closure member extending from the first base strip toward the second panel section, (A) the first closure profile being secured to the first panel section along a first side of the first base strip opposite the second panel section, (ii) a second closure profile having a second base strip and a second interlocking closure member extending from the second base strip toward the first panel section, (A) the second closure profile being secured to the second panel section along a first side of the second base strip opposite the first panel section, (iii) the first and second closure profiles being constructed to selectively interlock, an improvement comprising:

(a) the first side of the first base strip having a first elongate surface and a first bent surface portion;

(i) the first bent surface portion extending at a first angle from the first elongate surface and toward the second panel section;

(ii) the first panel section includes a portion extending in alignment with the first bent surface portion;

(b) the first side of the second base strip having a second elongate surface and a second bent surface portion;

(i) the second bent surface portion extending at a second angle from the second elongate surface and toward the first panel section; and (ii) the second panel section including a portion extending in alignment with the second bent surface portion.

2. A package according to claim 1, wherein:

(a) the first panel section is sealed to the second panel section along a bottom edge.

3. A package according to claim 1, wherein:

(a) the first and second angles are equal.

4. A package according to claim 1, wherein:

(a) the first bent surface portion is positioned directly opposite a portion of the first closure profile.

5. A package according to claim 4 wherein:

(a) the first bent surface portion comprises a portion of the first base strip projecting toward the first side of the second base strip from the first closure profile.

6. A package according to claim 5 wherein:

(a) the second bent surface portion is positioned directly opposite a portion of the second closure profile.

7. A package according to claim 6 wherein:

(a) the second bent surface portion comprises a portion of the second base strip projecting toward the first side of the first base strip from the second closure profile.

8. A package according to claim 1, wherein:

(a) the first interlocking closure member includes first and second closure flanges and first and second guide posts.

9. A package according to claim 8, wherein:

(a) the second interlocking closure member includes third and fourth closure flanges and a third guide post; and (b) the first closure flange being constructed to interlock with the third closure flange; and, the second closure flange being constructed to interlock with the fourth closure flange.

10. A package according to claim 1, including:

(a) a first sealant layer securing the first closure profile to the first panel section; and (b) a second sealant layer securing the second closure profile to the second panel section.

11. A method of manufacturing a resealable package comprising:

(a) providing first and second opposing panel sections and a closure arrangement;

(b) placing the closure arrangement between the first and second panel sections, the closure arrangement including:

(i) a first closure profile having a first base strip and a first interlocking closure member extending from the first base strip toward the second panel section;

(A) a first side of the first base strip having a first elongate surface and a first bent surface portion;

(1) the first bent surface portion extending at a first angle from the first elongate surface toward the second panel section;

(ii) a second closure profile having a second base strip and a second interlocking closure member extending from the second base strip toward the first panel section;

(A) the first side of the second base strip having a second elongate surface and a second bent surface portion;

(1) the second bent surface portion extending at a second angle from the second elongate surface toward the first panel section; and (c) securing a portion of the first panel section to the first bent surface portion and a portion of the first panel section to the first elongate surface of the first base strip.

12. A method according to claim 11, including:

(a) securing a portion of the second panel section to the second bent surface portion and a portion of the second panel section to the second elongate surface of the second base strip.

13. A method according to claim 12, including:

(a) sealing selected edges of the first panel section to selected edges of the second panel section.

14. A method according to claim 13, including:

(a) securing the first panel section to the first bent surface portion with a first sealant layer; and (b) securing the second panel section to the second bent surface portion with a second sealant layer.

* * * * *